US011371217B2

(12) United States Patent
Daimon

(10) Patent No.: US 11,371,217 B2
(45) Date of Patent: Jun. 28, 2022

(54) WORK MACHINE AND SYSTEM INCLUDING WORK MACHINE

(71) Applicant: KOMATSU LTD., Tokyo (JP)

(72) Inventor: Masaki Daimon, Tokyo (JP)

(73) Assignee: KOMATSU LTD., Tokyo (JP)

( * ) Notice: Subject to any disclaimer, the term of this patent is extended or adjusted under 35 U.S.C. 154(b) by 204 days.

(21) Appl. No.: 16/647,974

(22) PCT Filed: Feb. 19, 2019

(86) PCT No.: PCT/JP2019/005985
§ 371 (c)(1),
(2) Date: Mar. 17, 2020

(87) PCT Pub. No.: WO2019/181325
PCT Pub. Date: Sep. 26, 2019

(65) Prior Publication Data

US 2020/0263394 A1 Aug. 20, 2020

(30) Foreign Application Priority Data

Mar. 22, 2018 (JP) ..... JP2018-055079

(51) Int. Cl.

| | |
|---|---|
| ***E02F 9/26*** | (2006.01) |
| ***E02F 3/28*** | (2006.01) |
| ***E02F 9/20*** | (2006.01) |
| ***G07C 5/02*** | (2006.01) |

(52) U.S. Cl.
CPC ..... *E02F 9/26* (2013.01); *E02F 3/283* (2013.01); *E02F 9/2004* (2013.01); *G07C 5/02* (2013.01)

(58) Field of Classification Search
CPC ... E02F 3/283; E02F 3/431; E02F 9/20; E02F 9/2004; E02F 9/26; E02F 9/264; E02F 9/267; G07C 5/02
See application file for complete search history.

(56) References Cited

U.S. PATENT DOCUMENTS 6,205,687 B1 * 3/2001 Rocke ..... E02F 3/431 37/348
9,487,931 B2 * 11/2016 Atkinson ..... E02F 9/2045
9,691,025 B2 6/2017 Kirsch
(Continued)

FOREIGN PATENT DOCUMENTS

CN 103080433 A 5/2013
EP 3677882 A1 7/2020
(Continued)

OTHER PUBLICATIONS

English translation of Written Opinion of International Searching Authority dated Apr. 16, 2019 for PCT/JP2019/005985.

*Primary Examiner* — Tyler J Lee
(74) *Attorney, Agent, or Firm* — Faegre Drinker Biddle & Reath LLP

(57) ABSTRACT

Work contents by a work implement are more accurately distinguished. Work contents by the work implement include at least two of dozing, piling, and excavation and loading. A controller distinguishes work contents by the work implement. The controller identifies work contents during a period from start of the works until end of the works based on a result of distinction between at least two temporally distant work contents in work records during the period from the start of the works until the end of the works.

18 Claims, 14 Drawing Sheets

(56) References Cited

U.S. PATENT DOCUMENTS

| | | | | |
|---|---|---|---|---|
| 9,732,502 | B2 * | 8/2017 | Fletcher | E02F 3/431 |
| 2009/0139119 | A1 * | 6/2009 | Janardhan | E02F 9/264 37/413 |
| 2009/0143896 | A1 * | 6/2009 | Janardhan | B25J 9/1638 700/213 |
| 2012/0136542 | A1 * | 5/2012 | Upcroft | E02F 3/48 701/50 |
| 2013/0158786 | A1 | 6/2013 | Fukano et al. | |
| 2013/0317684 | A1 | 11/2013 | Kaneko et al. | |
| 2016/0076225 | A1 * | 3/2016 | Atkinson | G01S 17/00 701/50 |
| 2016/0078340 | A1 | 3/2016 | Kirsch | |
| 2017/0191245 | A1 * | 7/2017 | Shatters | E02F 3/283 |
| 2018/0051445 | A1 | 2/2018 | Hori et al. | |
| 2018/0142442 | A1 | 5/2018 | Tsuji | |
| 2019/0026914 | A1 * | 1/2019 | Hageman | E02F 9/2029 |

FOREIGN PATENT DOCUMENTS

| | | | |
|---|---|---|---|
| JP | S62-274223 | A | 11/1987 |
| JP | H02-132581 | A | 5/1990 |
| JP | H04-70348 | U | 6/1992 |
| JP | 2001-99701 | A | 4/2001 |
| JP | 2014-112329 | A | 6/2014 |
| WO | WO-2012/114782 | A1 | 8/2012 |
| WO | WO-2016/208275 | A1 | 12/2016 |
| WO | WO 2017/033595 | A1 | 3/2017 |

* cited by examiner

FIG.5

| WORK STEP | | | UNLOADED FORWARD TRAVEL | EXCAVATION (PUSHING) | EXCAVATION (SCOOPING) | LOADED REARWARD TRAVEL | LOADED FORWARD TRAVEL | SOIL EJECTION | REARWARD TRAVEL BOOM LOWERING | SIMPLE TRAVELING |
|---|---|---|---|---|---|---|---|---|---|---|
| FORWARD AND REARWARD TRAVEL SWITCHING LEVER | F | | ○ | ○ | ○ | | ○ | ○ | | (○) |
| | N | | | | | | | | | |
| | R | | | | | ○ | | | ○ | |
| OPERATION OF WORK IMPLEMENT | BOOM | LOWER | | | | | | | ○ | |
| | | NEUTRAL | ○ | ○ | (○) | (○) | (○) | (○) | | ○ |
| | | RAISE | | | (○) | (○) | (○) | (○) | | |
| | BUCKET | DUMP | | | | | | ○ | | |
| | | NEUTRAL | ○ | ○ | | ○ | ○ | | | ○ |
| | | TILT BACK | | | ○ | | | | ○ | |
| PRESSURE OF CYLINDER OF WORK IMPLEMENT | | | LOWER THAN P | A–C | A–C | B–P | B–P | B–P | LOWER THAN P | LOWER THAN C |

FIG.9

(A)DOZING OPERATION

START OF EXCAVATION — END OF EXCAVATION

| TIME | | | 0 | 1 | 2 | 3 | 4 |
|---|---|---|---|---|---|---|---|
| FORWARD AND REARWARD TRAVEL SWITCHING LEVER | F | | ○ | ○ | ○ | ○ | |
| | N | | | | | | |
| | R | | | | | | ○ |
| OPERATION OF WORK IMPLEMENT | BOOM | LOWER | | | | | |
| | | NEUTRAL | ○ | ○ | ○ | ○ ○ | ○ ○ |
| | | RAISE | | | | | |
| | BUCKET | DUMP | | | | ○ ○ | ○ ○ |
| | | NEUTRAL | ○ | ○ | ○ | | |
| | | TILT BACK | | | | | |

(B)EXCAVATION AND LOADING OPERATION

START OF EXCAVATION — END OF EXCAVATION

| TIME | | | 0 | 1 | 2 | 3 | 4 |
|---|---|---|---|---|---|---|---|
| FORWARD AND REARWARD TRAVEL SWITCHING LEVER | F | | ○ | ○ | ○ | ○ | |
| | N | | | | | | |
| | R | | | | | | ○ |
| OPERATION OF WORK IMPLEMENT | BOOM | LOWER | | | | | |
| | | NEUTRAL | ○ | ○ ○ | ○ ○ | ○ ○ | ○ ○ |
| | | RAISE | | | | | |
| | BUCKET | DUMP | | | | | |
| | | NEUTRAL | ○ | ○ ○ | ○ ○ | ○ ○ | ○ ○ |
| | | TILT BACK | | | | | |

(C)PILING OPERATION

START OF EXCAVATION — END OF EXCAVATION

| TIME | | | 0 | 1 | 2 | 3 | 4 |
|---|---|---|---|---|---|---|---|
| FORWARD AND REARWARD TRAVEL SWITCHING LEVER | F | | ○ | ○ | ○ | ○ | |
| | N | | | | | | |
| | R | | | | | | ○ |
| OPERATION OF WORK IMPLEMENT | BOOM | LOWER | | | | | |
| | | NEUTRAL | ○ | ○ ○ | ○ ○ | ○ ○ | ○ ○ |
| | | RAISE | | | | | |
| | BUCKET | DUMP | | | | ○ ○ | ○ ○ |
| | | NEUTRAL | ○ | ○ ○ | ○ ○ | | |
| | | TILT BACK | | | | | |

FIG.10
(1) RELATION BETWEEN CUTTING EDGE TRACE X AND CUTTING EDGE TRACE Y
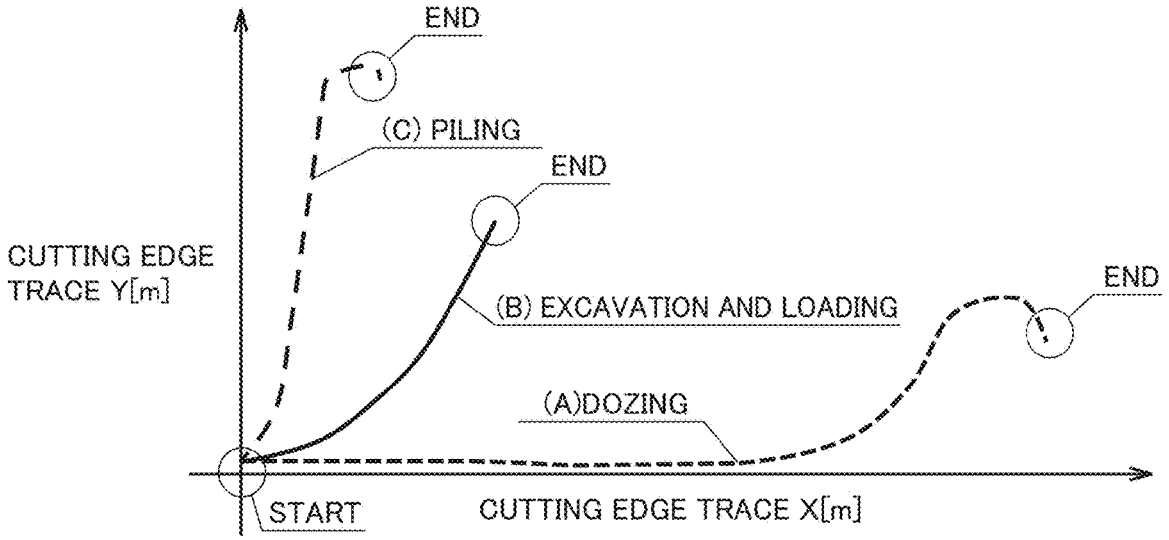
(2) RELATION BETWEEN CUTTING EDGE TRACE X AND BUCKET ANGLE
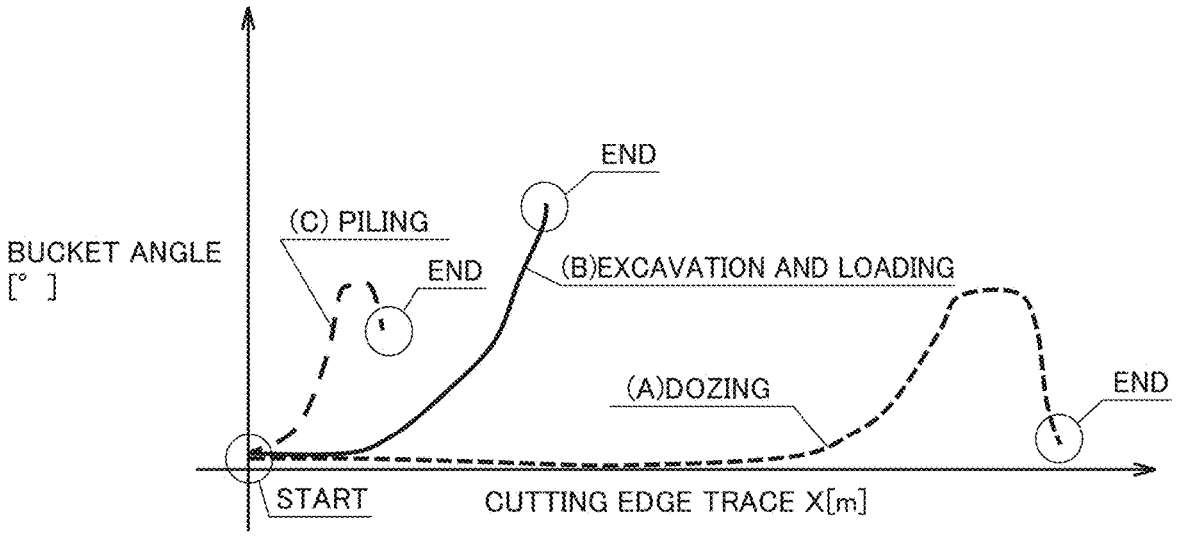

FIG.11

| TIME | WORK STEP | EXCAVATION CATEGORY (BEFORE UPDATE) | EXCAVATION CATEGORY (AFTER UPDATE) |
|---|---|---|---|
| 0 | UNLOADED FORWARD TRAVEL | – | – |
| 1 | UNLOADED FORWARD TRAVEL | – | – |
| 2 | UNLOADED FORWARD TRAVEL | – | – |
| 3 | UNLOADED FORWARD TRAVEL | – | – |
| 4 | UNLOADED FORWARD TRAVEL | – | – |
| 5 | UNLOADED FORWARD TRAVEL | – | – |
| 6 | EXCAVATION | UNKNOWN | PILING |
| 7 | EXCAVATION | UNKNOWN | PILING |
| 8 | EXCAVATION | UNKNOWN | PILING |
| 9 | EXCAVATION | UNKNOWN | PILING |
| 10 | EXCAVATION | UNKNOWN | PILING |
| 11 | EXCAVATION | UNKNOWN | PILING |
| 12 | EXCAVATION | UNKNOWN | PILING |
| 13 | EXCAVATION | EXCAVATION AND LOADING | PILING |
| 14 | EXCAVATION | EXCAVATION AND LOADING | PILING |
| 15 | EXCAVATION | EXCAVATION AND LOADING | PILING |
| 16 | EXCAVATION | EXCAVATION AND LOADING | PILING |
| 17 | EXCAVATION | EXCAVATION AND LOADING | PILING |
| 18 | EXCAVATION | PILING | PILING |
| 19 | EXCAVATION | PILING | PILING |
| 20 | EXCAVATION | PILING | PILING |
| 21 | EXCAVATION | PILING | PILING |
| 22 | LOADED REARWARD TRAVEL | – | – |
| 23 | LOADED REARWARD TRAVEL | – | – |
| 24 | LOADED REARWARD TRAVEL | – | – |

WORK MACHINE AND SYSTEM INCLUDING WORK MACHINE

TECHNICAL FIELD

The present disclosure relates to a work machine and a system including a work machine.

BACKGROUND ART

For a wheel loader, for example, Japanese Patent Laying-Open No. 2-132581 (PTL 1) discloses a technique for distinguishing among a direct work, an indirect work, and a stand-by work based on a detection signal from a detection device provided in a wheel loader main body.

CITATION LIST

Patent Literature

PTL 1: Japanese Patent Laying-Open No. 2-132581

SUMMARY OF INVENTION

Technical Problem

Among works by a wheel loader, an excavation and loading work in which a vehicle travels forward, a boom is raised to scoop soil into a bucket, and scooped soil is loaded onto a box of a dump truck represents one of works that consume much fuel. A load value (a payload weight) of soil obtained by the excavation and loading work is a factor relevant to productivity of the wheel loader. Therefore, the excavation and loading work is an important work in terms of fuel efficiency and productivity.

The wheel loader may perform a piling work in which soil scooped into the bucket is ejected at the site and piled up, as a work in which an operation to raise a boom is performed as in excavation and loading but loading is not performed. Though the piling work is a work for neatly piling soil for facilitating the excavation and loading work, it is not directly relevant to production achieved by the wheel loader.

In order to accurately measure a payload weight per unit fuel consumption amount, accurate distinction between the excavation and loading work and the piling work has been desired. In order to appropriately train an operator, accurate distinction between the excavation and loading work and the piling work, extraction of operation data in the excavation and loading work, and training based on extracted data have been desired.

The present disclosure provides a work machine capable of more accurately distinguishing contents of works by a work implement and a system including the work machine.

Solution to Problem

According to one aspect of the present disclosure, a work machine including a vehicular body, a work implement attached to the vehicular body, and a controller that distinguishes work contents by the work implement is provided. The work contents by the work implement include at least two of dozing, piling, and excavation and loading. The controller identifies the work contents during a period from start of works until end of the works based on a result of distinction between at least two temporally distant work contents in work records during the period from the start of the works until the end of the works.

According to one aspect of the present disclosure, a work machine including a vehicular body, a work implement attached to the vehicular body, and a controller that distinguishes work contents by the work implement is provided. The work contents by the work implement include at least two of dozing, piling, and excavation and loading. The controller distinguishes the work contents at the end of works and identifies the work contents distinguished at the end of the works as the work contents during a period from start of the works until the end of the works.

Advantageous Effects of Invention

According to the present disclosure, contents of works by the work implement can more accurately be distinguished.

BRIEF DESCRIPTION OF DRAWINGS

FIG. 5 shows a table showing a determination method in the series of work steps included in the excavation operation and the loading operation by the wheel loader.

FIG. 9 shows a table for distinguishing contents of works by the wheel loader.

FIG. 10 shows a graph of a trace of a cutting edge of a bucket during works by the wheel loader.

FIG. 11 shows an exemplary table showing work records.

DESCRIPTION OF EMBODIMENTS

Figure 1:
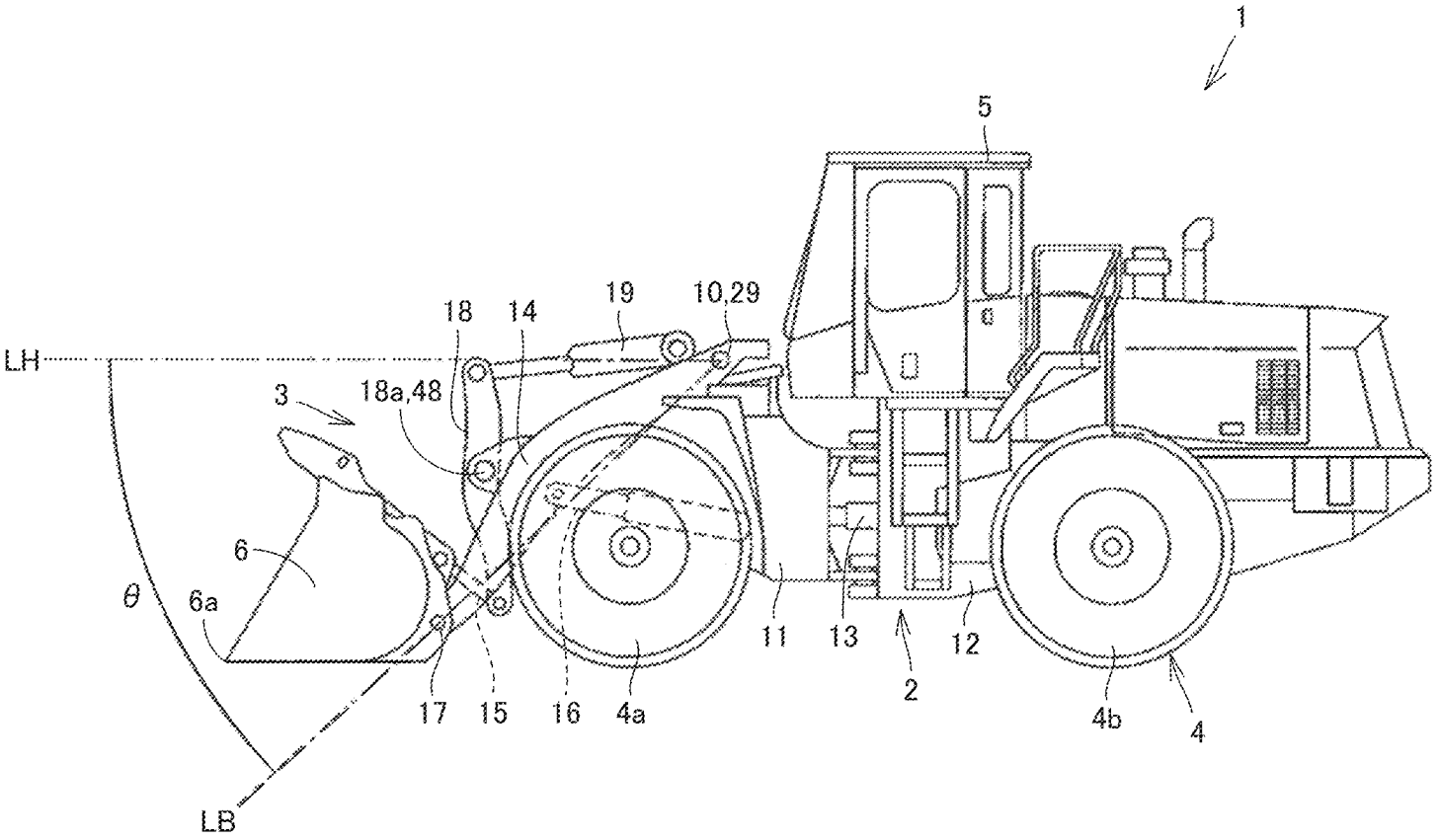
FIG. 1 is a side view of a wheel loader based on an embodiment.

An embodiment will be described below with reference to the drawings. The same elements have the same reference characters allotted in the description below and their labels and functions are also the same. Therefore, detailed description thereof will not be repeated.

Overall Configuration

A wheel loader 1 will be described by way of example of a work machine in the embodiment. FIG. 1 is a side view of wheel loader 1 based on the embodiment.

As shown in FIG. 1, wheel loader 1 includes a vehicular body frame 2, a work implement 3, a traveling unit 4, and a cab 5. Traveling unit 4 includes running wheels 4*a* and 4*b*.

Wheel loader 1 is mobile as running wheels 4*a* and 4*b* are rotationally driven, and can perform a desired work with work implement 3.

Vehicular body frame 2 has a front frame 11 and a rear frame 12. Front frame 11 and rear frame 12 are attached to each other in a manner swingable in a lateral direction. A steering cylinder 13 is attached to front frame 11 and rear frame 12. Steering cylinder 13 is a hydraulic cylinder. As steering cylinder 13 extends and contracts as being driven by hydraulic oil from a steering pump (not shown), a direction of travel of wheel loader 1 is laterally changed.

A direction in which wheel loader 1 travels in straight lines is herein referred to as a fore/aft direction of wheel loader 1. In the fore/aft direction of wheel loader 1, a side where work implement 3 is arranged with respect to vehicular body frame 2 is defined as the fore direction and a direction opposite to the fore direction is defined as the aft direction. A lateral direction of wheel loader 1 is a direction orthogonal to the fore/aft direction in a plan view. A right side and a left side in the lateral direction in facing front are defined as a right direction and a left direction, respectively. An upward/downward direction of wheel loader 1 is a direction orthogonal to the plane defined by the fore/aft direction and the lateral direction. A side in the upward/downward direction where the ground is located is defined as a lower side and a side where the sky is located is defined as an upper side.

The fore/aft direction refers to a fore/aft direction of an operator who sits at an operator's seat in cab 5. The lateral direction refers to a lateral direction of the operator who sits at the operator's seat. The lateral direction refers to a direction of a vehicle width of wheel loader 1. The upward/downward direction refers to an upward/downward direction of the operator who sits at the operator's seat. A direction in which the operator sitting at the operator's seat faces is defined as the fore direction and a direction behind the operator sitting at the operator's seat is defined as the aft direction. A right side and a left side at the time when the operator sitting at the operator's seat faces front are defined as the right direction and the left direction, respectively. A foot side of the operator who sits at the operator's seat is defined as a lower side, and a head side is defined as an upper side.

Work implement 3 and running wheel 4*a* are attached to front frame 11. Work implement 3 includes a boom 14 and a bucket 6. A base end of boom 14 is rotatably attached to front frame 11 by a boom pin 10. Bucket 6 is rotatably attached to boom 14 by a bucket pin 17 located at a tip end of boom 14. Front frame 11 and boom 14 are coupled to each other by a boom cylinder 16. Boom cylinder 16 is a hydraulic cylinder. As boom cylinder 16 extends and contracts as being driven by hydraulic oil from a work implement pump 25 (see FIG. 2), boom 14 moves upward and downward. Boom cylinder 16 drives boom 14.

Work implement 3 further includes a bell crank 18, a tilt cylinder 19, and a tilt rod 15. Bell crank 18 is rotatably supported on boom 14 by a support pin 18*a* located substantially in the center of boom 14. Tilt cylinder 19 couples a base end of bell crank 18 and front frame 11 to each other. Tilt rod 15 couples a tip end of bell crank 18 and bucket 6 to each other. Tilt cylinder 19 is a hydraulic cylinder. As tilt cylinder 19 extends and contracts as being driven by hydraulic oil from work implement pump 25 (see FIG. 2), bucket 6 pivots upward and downward. Tilt cylinder 19 drives bucket 6.

Cab 5 and running wheel 4*b* are attached to rear frame 12. Cab 5 is arranged in the rear of boom 14. Cab 5 is carried on vehicular body frame 2. A seat where an operator sits and an operation apparatus are arranged in cab 5.

Figure 2:
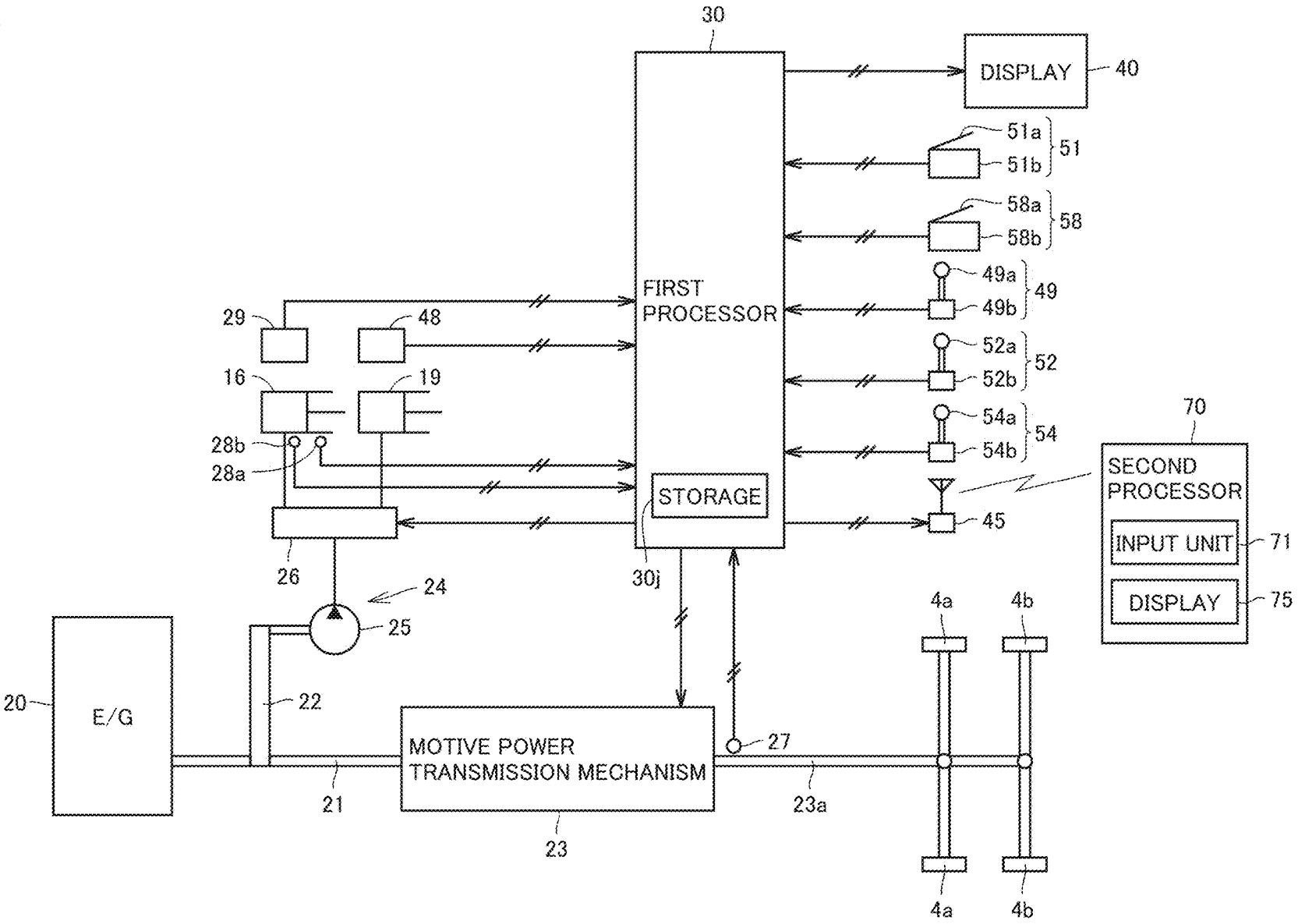
FIG. 2 is a schematic block diagram of the wheel loader.

FIG. 2 is a schematic block diagram showing a configuration of wheel loader 1. Wheel loader 1 includes an engine 20, a motive power extraction unit 22, a motive power transmission mechanism 23, a cylinder driving unit 24, a first angle detector 29, a second angle detector 48, and a first processor 30.

Engine 20 is, for example, a diesel engine. Output from engine 20 is controlled by adjusting an amount of fuel to be injected into a cylinder of engine 20.

Motive power extraction unit 22 is an apparatus that distributes output from engine 20 to motive power transmission mechanism 23 and cylinder driving unit 24.

Motive power transmission mechanism 23 is a mechanism that transmits driving force from engine 20 to front wheel 4*a* and rear wheel 4*b*. Motive power transmission mechanism 23 changes a speed of rotation of an input shaft 21 and outputs resultant rotation to an output shaft 23*a*.

A vehicle speed detector 27 that detects a speed of wheel loader 1 is attached to output shaft 23*a* of motive power transmission mechanism 23. Wheel loader 1 includes vehicle speed detector 27. Vehicle speed detector 27 detects a speed of movement of wheel loader 1 by traveling unit 4 by detecting a rotation speed of output shaft 23*a*. Vehicle speed detector 27 functions as a rotation sensor that detects a rotation speed of output shaft 23*a*. Vehicle speed detector 27 functions as a movement detector that detects movement by traveling unit 4. Vehicle speed detector 27 outputs a detection signal representing a vehicle speed of wheel loader 1 to first processor 30.

Cylinder driving unit 24 includes work implement pump 25 and a control valve 26. Output from engine 20 is transmitted to work implement pump 25 through motive power extraction unit 22. Hydraulic oil delivered from work implement pump 25 is supplied to boom cylinder 16 and tilt cylinder 19 through control valve 26.

First hydraulic pressure detectors 28*a* and 28*b* that detect a hydraulic pressure in an oil chamber in boom cylinder 16 are attached to boom cylinder 16. Wheel loader 1 includes first hydraulic pressure detectors 28*a* and 28*b*. First hydraulic pressure detectors 28*a* and 28*b* include, for example, a pressure sensor 28*a* for head pressure detection and a pressure sensor 28*b* for bottom pressure detection.

Pressure sensor 28*a* is attached to a head side of boom cylinder 16. Pressure sensor 28*a* can detect a pressure (a head pressure) of hydraulic oil in the oil chamber on a side of a cylinder head of boom cylinder 16. Pressure sensor 28*a* outputs a detection signal representing a head pressure of boom cylinder 16 to first processor 30.

Pressure sensor 28*b* is attached to a bottom side of boom cylinder 16. Pressure sensor 28*b* can detect a pressure (a bottom pressure) of hydraulic oil in the oil chamber on a side of a cylinder bottom of boom cylinder 16. Pressure sensor 28*b* outputs a detection signal representing a bottom pressure of boom cylinder 16 to first processor 30.

For example, a potentiometer attached to boom pin 10 is employed as first angle detector 29. First angle detector 29 detects a boom angle representing a lift angle (a tilt angle) of boom 14. First angle detector 29 outputs a detection signal representing a boom angle to first processor 30.

Specifically, as shown in FIG. 1, a boom angle θ represents an angle of a straight line LB extending in a direction from the center of boom pin 10 toward the center of bucket pin 17 with respect to a horizontal line LH extending forward from the center of boom pin 10. A case that straight line LB is horizontal is defined as boom angle θ=0°. A case that straight line LB is located above horizontal line LH is defined as a positive boom angle θ. A case that straight line LB is located below horizontal line LH is defined as a negative boom angle θ.

A stroke sensor arranged in boom cylinder 16 may be employed as first angle detector 29.

For example, a potentiometer attached to support pin 18*a* is employed as second angle detector 48. Second angle detector 48 detects a bucket angle representing a tilt angle of bucket 6 with respect to boom 14 by detecting an angle of bell crank 18 (bell crank angle) with respect to boom 14. Second angle detector 48 outputs a detection signal representing a bucket angle to first processor 30. The bucket angle is, for example, an angle formed between straight line LB and a straight line that connects the center of bucket pin 17 and a cutting edge 6*a* of bucket 6 to each other. When cutting edge 6*a* of bucket 6 is located above straight line LB, the bucket angle is defined as positive.

A stroke sensor arranged in tilt cylinder 19 may be employed as second angle detector 48.

Wheel loader 1 includes in cab 5, an operation apparatus operated by an operator. The operation apparatus includes a forward and rearward travel switching apparatus 49, an accelerator operation apparatus 51, a boom operation apparatus 52, a bucket operation apparatus 54, and a brake operation apparatus 58.

Forward and rearward travel switching apparatus 49 includes an operation member 49*a* and a member position detection sensor 49*b*. Operation member 49*a* is operated by an operator for indicating switching between forward travel and rearward travel of the vehicle. Operation member 49*a* can be switched to a position of each of forward travel (F), neutral (N), and rearward travel (R). Member position detection sensor 49*b* detects a position of operation member 49*a*. Member position detection sensor 49*b* outputs to first processor 30, a detection signal (forward travel, neutral, or rearward travel) representing a command to travel forward or rearward indicated by a position of operation member 49*a*.

Accelerator operation apparatus 51 includes an accelerator operation member 51*a* and an accelerator operation detection unit 51*b*. Accelerator operation member 51*a* is operated by an operator for setting a target rotation speed of engine 20. Accelerator operation detection unit 51*b* detects an amount of operation onto accelerator operation member 51*a* (an amount of accelerator operation). Accelerator operation detection unit 51*b* outputs a detection signal representing an amount of accelerator operation to first processor 30.

Brake operation apparatus 58 includes a brake operation member 58*a* and a brake operation detection unit 58*b*. Brake operation member 58*a* is operated by an operator for controlling deceleration force of wheel loader 1. Brake operation detection unit 58*b* detects an amount of operation onto brake operation member 58*a* (an amount of brake operation). Brake operation detection unit 58*b* outputs a detection signal representing an amount of brake operation to first processor 30. A pressure of brake oil may be used as an amount of brake operation.

Boom operation apparatus 52 includes a boom operation member 52*a* and a boom operation detection unit 52*b*. Boom operation member 52*a* is operated by an operator for raising or lowering boom 14. Boom operation detection unit 52*b* detects a position of boom operation member 52*a*. Boom operation detection unit 52*b* outputs to first processor 30, a detection signal representing a command to raise or lower boom 14 indicated by the position of boom operation member 52*a*.

Bucket operation apparatus 54 includes a bucket operation member 54*a* and a bucket operation detection unit 54*b*. Bucket operation member 54*a* is operated by an operator for causing bucket 6 to perform an excavation operation or a dumping operation. Bucket operation detection unit 54*b* detects a position of bucket operation member 54*a*. Bucket operation detection unit 54*b* outputs to first processor 30, a detection signal representing a command to operate bucket 6 in an excavation direction or a dump direction indicated by a position of bucket operation member 54*a*.

First angle detector 29, second angle detector 48, first hydraulic pressure detectors 28*a* and 28*b*, boom operation detection unit 52*b*, and bucket operation detection unit 54*b* are included in a work implement sensor. The work implement sensor senses a state of work implement 3. A weight of loads in bucket 6 can be calculated based on a detection value from the work implement sensor. The work implement sensor includes at least one of a pressure sensor and a strain sensor. The work implement sensor includes a work implement position sensor. The work implement position sensor is constituted, for example, of first angle detector 29, second angle detector 48, boom operation detection unit 52*b*, and bucket operation detection unit 54*b*.

First processor 30 is implemented by a microcomputer including a storage such as a random access memory (RAM) or a read only memory (ROM) and a computing device such as a central processing unit (CPU). First processor 30 may be implemented as some of functions of a controller of wheel loader 1 that controls operations of engine 20, work implement 3, and motive power transmission mechanism 23. A signal representing a vehicle speed of wheel loader 1 detected by vehicle speed detector 27, a signal representing a boom angle detected by first angle detector 29, a signal representing a bottom pressure of boom cylinder 16 detected by pressure sensor 28*b*, and a signal representing a forward and rearward travel command detected by forward and rearward travel switching apparatus 49 are input to first processor 30. First processor 30 obtains by summation, work information on transportation of loads in bucket 6 based on the input signals.

The transportation work information refers, for example, to the number of times of transportation works, a total weight in transportation, a total distance of transportation, and a total workload. The number of times of transportation works represents the number of times of prescribed transportation works such as V-shape loading during a period from start until end of summation. The period from start until end of summation means, for example, a period for which an operator drives wheel loader 1 within a prescribed time period such as one day. The period is desirably managed for each operator. The period may manually be set by an operator. The total weight in transportation means a total weight of loads transported by bucket 6 during a period from start until end of summation. The total distance of transportation means a total distance of movement of wheel loader 1 with bucket 6 being loaded during a period from start until end of summation. The total workload means a product of the total weight in transportation and the total distance of transportation during a period from start until end of summation.

A signal representing a bucket angle detected by second angle detector 48 is input to first processor 30. First processor 30 calculates a current position of cutting edge 6*a* of bucket 6 based on a signal representing a vehicle speed of wheel loader 1, a signal representing a boom angle, and a signal representing a bucket angle.

Wheel loader 1 further includes a display 40 and an output unit 45. Display 40 is implemented by a monitor arranged in cab 5 and viewed by an operator. Display 40 shows transportation work information obtained by summation by first processor 30.

Output unit 45 outputs transportation work information to a server (a second processor 70) provided outside wheel loader 1. Output unit 45 may have a communication function such as wireless communication and may communicate with an input unit 71 of second processor 70. Alternatively, output unit 45 may be implemented, for example, by an interface of a portable storage (such as a memory card) that can be accessed from input unit 71 of second processor 70. Second processor 70 includes a display 75 that performs a monitor function and can show transportation work information output from output unit 45.

Excavation Work

Figure 3:
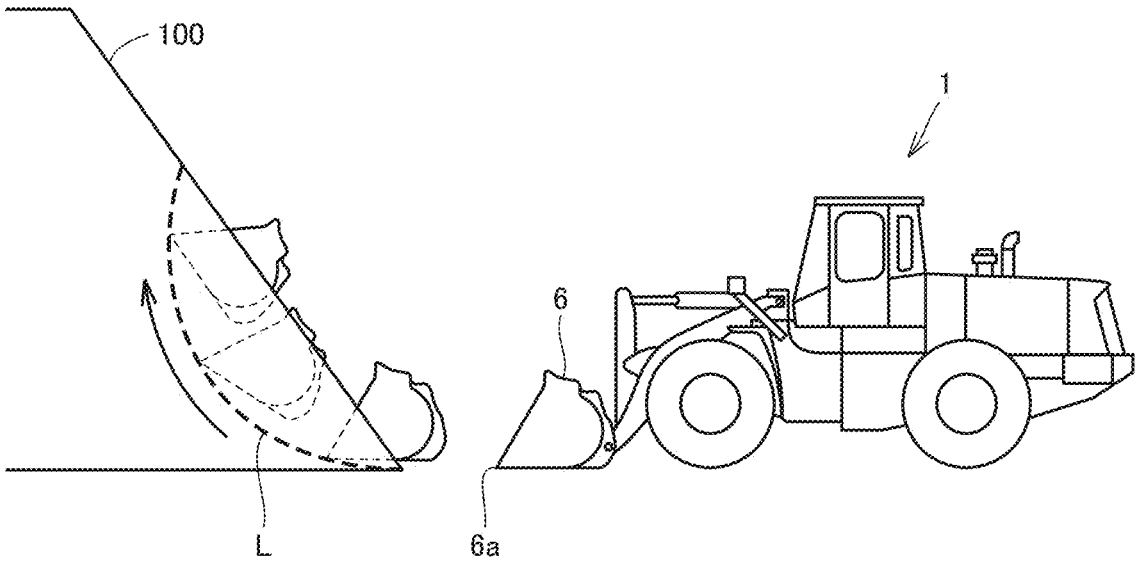
FIG. 3 illustrates an excavation work by the wheel loader based on the embodiment.

Wheel loader 1 in the present embodiment performs an excavation work for scooping an excavated object such as soil. FIG. 3 illustrates an excavation work by wheel loader 1 based on the embodiment.

As shown in FIG. 3, wheel loader 1 pushes cutting edge 6*a* of bucket 6 into an excavated object 100 and thereafter raises bucket 6 along a bucket trace L as shown with a curved arrow in FIG. 3. The excavation work for scooping excavated object 100 is thus performed.

Figure 4:
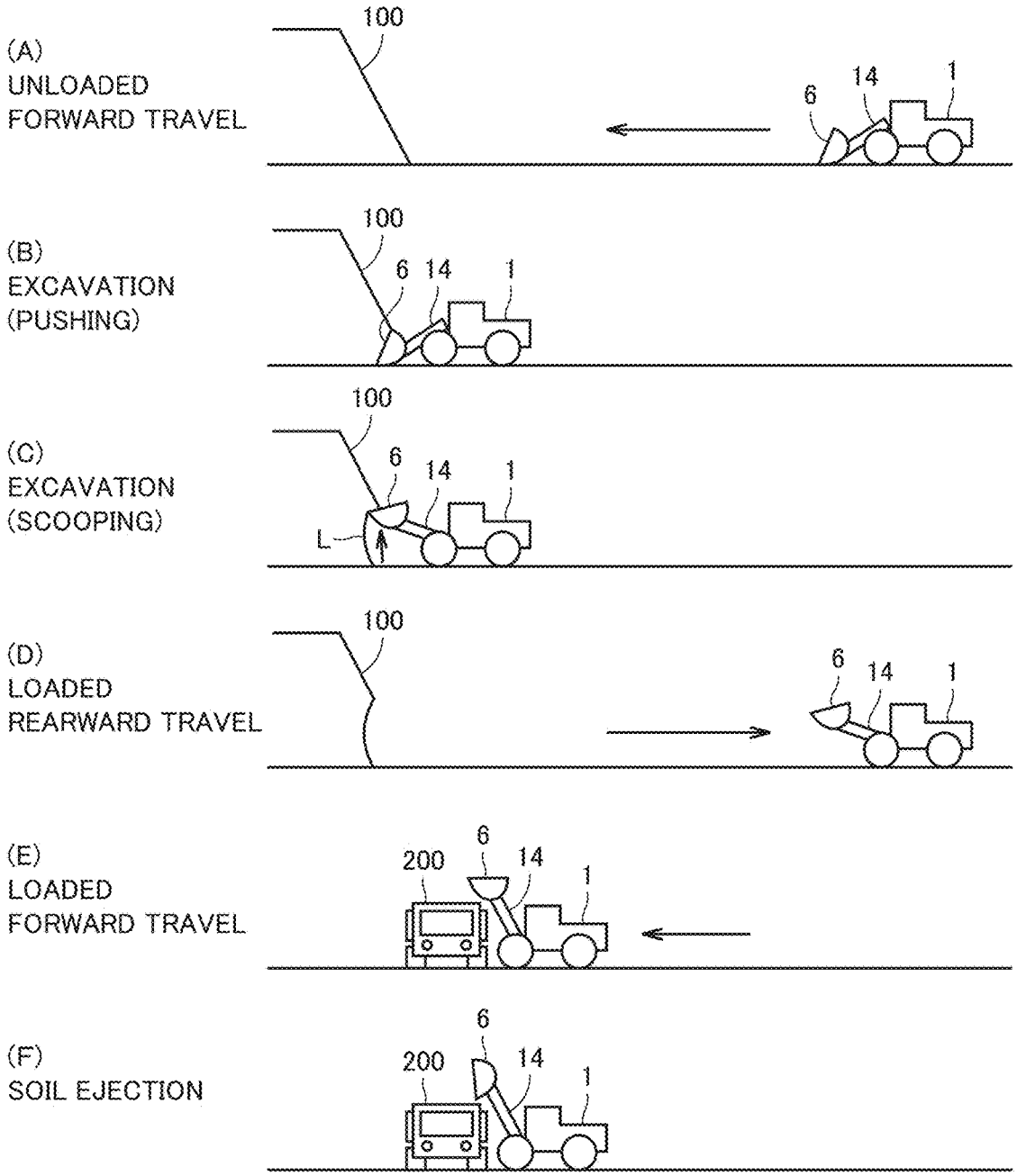
FIG. 4 is a schematic diagram showing an example of a series of work steps included in an excavation operation and a loading operation by the wheel loader.

Wheel loader 1 in the present embodiment performs an excavation operation for scooping excavated object 100 in bucket 6 and a loading operation for loading objects (excavated object 100) in bucket 6 onto a transportation machine such as a dump truck 200. FIG. 4 is a schematic diagram showing an example of a series of work steps included in an excavation operation and a loading operation by wheel loader 1 based on the embodiment. Wheel loader 1 excavates excavated object 100 and loads excavated object 100 on a transportation machine such as dump truck 200 by successively repeating a plurality of works steps as follows.

As shown in FIG. 4 (A), wheel loader 1 travels forward toward excavated object 100. In this unloaded forward travel step, an operator operates boom cylinder 16 and tilt cylinder 19 to set work implement 3 to an excavation attitude in which the tip end of boom 14 is located at a low position and bucket 6 is horizontally oriented, and moves wheel loader 1 forward toward excavated object 100.

As shown in FIG. 4 (B), the operator moves wheel loader 1 forward until cutting edge 6*a* of bucket 6 is pushed into excavated object 100. In this excavation (pushing) step, cutting edge 6*a* of bucket 6 is pushed into excavated object 100.

As shown in FIG. 4 (C), the operator thereafter operates boom cylinder 16 to raise bucket 6 and operates tilt cylinder 19 to tilt back bucket 6. In this excavation (scooping) step, bucket 6 is raised along bucket trace L as shown with an arrow in the figure and excavated object 100 is scooped into bucket 6. An excavation work for scooping excavated object 100 is thus performed.

Depending on a type of excavated object 100, the scooping step may be completed simply by tilting back bucket 6 once. Alternatively, in the scooping step, an operation to tilt back bucket 6, set the bucket to a neutral position, and tilt back the bucket again may be repeated.

As shown in FIG. 4 (D), after excavated object 100 is scooped into bucket 6, the operator moves wheel loader 1 rearward in a loaded rearward travel step. The operator may raise the boom while moving the vehicle rearward, or may raise the boom while moving the vehicle forward in FIG. 4 (E).

As shown in FIG. 4 (E), the operator moves wheel loader 1 forward to be closer to dump truck 200 while keeping bucket 6 raised or raising bucket 6. As a result of this loaded forward travel step, bucket 6 is located substantially directly above a box of dump truck 200.

As shown in FIG. 4 (F), the operator dumps the excavated object from bucket 6 at a prescribed position and loads objects (excavated object) in bucket 6 on the box of dump truck 200. This step is what is called a soil ejection step. Thereafter, the operator lowers boom 14 and returns bucket 6 to the excavation attitude while the operator moves wheel loader 1 rearward.

The above is typical work steps defining one cycle of the excavation and loading work.

FIG. 5 shows a table showing a determination method in the series of work steps included in the excavation operation and the loading operation by wheel loader 1.

In the table shown in FIG. 5, a row of "work step" at the top lists names of work steps shown in FIG. 4 (A) to (F). In rows of "forward and rearward travel switching lever," "operation of work implement," and "pressure of cylinder of work implement" below, various criteria used by first processor 30 (FIG. 2) for determining under which step a current work step falls are shown.

More specifically, in the row of "forward and rearward travel switching lever," criteria for an operation performed by an operator onto a forward and rearward travel switching lever (operation member 49*a*) are shown with a circle.

In the row of "operation of work implement," criteria for an operation by an operator onto work implement 3 are shown with a circle. More specifically, in a row of "boom", criteria for an operation onto boom 14 are shown, and in a row of "bucket", criteria for an operation onto bucket 6 are shown.

In the row of "pressure of cylinder of work implement," criteria for a current hydraulic pressure of the cylinder of work implement 3 such as a hydraulic pressure of a cylinder bottom chamber of boom cylinder 16 are shown. Four reference values A, B, C, and P are set in advance for a hydraulic pressure, a plurality of pressure ranges (a range lower than reference value P, a range of reference values A to C, a range of reference values B to P, and a range lower than reference value C) are defined by reference values A, B, C, and P, and these pressure ranges are set as the criteria. Magnitude of four reference values A, B, C, and P is defined as A>B>C>P.

By using a combination of criteria for "forward and rearward travel switching lever," "boom", "bucket", and "pressure of cylinder of work implement" for each work step as above, first processor 30 can determine under which work step a currently performed work falls.

A specific operation of first processor 30 when control shown in FIG. 5 is carried out will be described below.

A combination of criteria for "forward and rearward travel switching lever," "boom", "bucket", and "pressure of cylinder of work implement" corresponding to each work step shown in FIG. 5 is stored in advance in a storage 30*j* (FIG. 2). First processor 30 recognizes a type (F, N, or R) of a current operation onto the forward and rearward travel switching lever based on a signal from forward and rearward travel switching apparatus 49. First processor 30 recognizes a type of a current operation onto boom 14 (lowering, neutral, or raising) based on a signal from boom operation detection unit 52*b*. First processor 30 recognizes a type of a current operation onto bucket 6 (dump, neutral, or tilt back) based on a signal from bucket operation detection unit 54*b*. First processor 30 recognizes a current hydraulic pressure of the cylinder bottom chamber of boom cylinder 16 based on a signal from pressure sensor 28*b* shown in FIG. 2.

First processor 30 compares combination of the recognized type of operation onto the forward and rearward travel switching lever, the type of the operation onto the boom, the type of the operation onto the bucket, and the hydraulic pressure of the boom cylinder at the current time point (that is, a current state of work) with combination of criteria for "forward and rearward travel switching lever," "boom", "bucket", and "pressure of cylinder of work implement" corresponding to each work step stored in advance. As a result of this comparison processing, first processor 30 determines to which work step the combination of criteria which matches best with the current state of work corresponds.

The combination of criteria corresponding to each work step included in the excavation and loading operation shown in FIG. 5 is specifically as follows.

In the unloaded forward travel step, the forward and rearward travel switching lever is set to F, the operation of the boom and the operation of the bucket are both set to neutral, and the pressure of the cylinder of the work implement is lower than reference value P.

In the excavation (pushing) step, the forward and rearward travel switching lever is set to F, the operation of the boom and the operation of the bucket are both neutral, and the pressure of the cylinder of the work implement is within the range of reference values A to C.

In the excavation (scooping) step, the forward and rearward travel switching lever is set to F or R, the operation of the boom is raising or neutral, the operation of the bucket is tilt back, and the pressure of the cylinder of the work implement is within the range of reference values A to C. For an operation of the bucket, such a criterion that tilt back and neutral are alternately repeated may further be added because, depending on a state of excavated object 100, an operation to tilt back bucket 6, set the bucket to a neutral position, and tilt back the bucket again may be repeated.

In the loaded rearward travel step, the forward and rearward travel switching lever is set to R, the operation of the boom is neutral or raising, the operation of the bucket is neutral, and the pressure of the cylinder of the work implement is within the range of reference values B to P.

In the loaded forward travel step, the forward and rearward travel switching lever is set to F, the operation of the boom is raising or neutral, the operation of the bucket is neutral, and the pressure of the cylinder of the work implement is within the range of reference values B to P.

In the soil ejection step, the forward and rearward travel switching lever is set to F, the operation of the boom is raising or neutral, the operation of the bucket is dump, and the pressure of the cylinder of the work implement is within the range of reference values B to P.

In the rearward travel•boom lowering step, the forward and rearward travel switching lever is set to R, the operation of the boom is lowering, the operation of the bucket is tilt back, and the pressure of the cylinder of the work implement is lower than reference value P.

FIG. 5 further shows a simple travel step in which wheel loader 1 simply travels. In the simple travel step, the operator moves wheel loader 1 forward with boom 14 being located at a low position. The wheel loader may transport loads with bucket 6 being loaded, or the wheel loader may travel with bucket 6 being unloaded. In the simple travel step, the forward and rearward travel switching lever is set to F (in travel forward; set to R in travel rearward), the operation of the boom is neutral, the operation of the bucket is neutral, and the pressure of the cylinder of the work implement is lower than reference value C.

Piling Work

Figure 6:
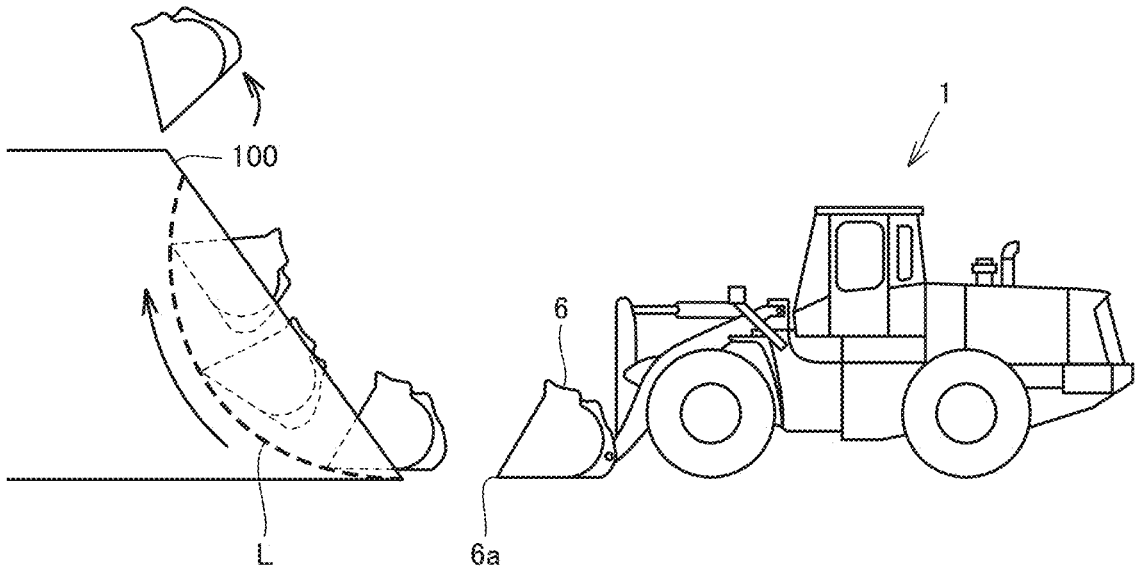
FIG. 6 is a diagram illustrating a piling work by the wheel loader based on the embodiment.

Wheel loader 1 in the present embodiment performs a piling work in which excavated object 100 such as soil scooped into bucket 6 is ejected at the site and piled up. FIG. 6 is a diagram illustrating a piling work by wheel loader 1 based on the embodiment.

As shown in FIG. 6, wheel loader 1 pushes cutting edge 6*a* of bucket 6 into excavated object 100 and thereafter raises bucket 6 along bucket trace L as shown with a curved arrow in FIG. 6. Wheel loader 1 further causes bucket 6 to perform a dumping operation. The piling work in which excavated object 100 scooped in bucket 6 is ejected at the site and piled up is thus performed.

In the piling work, the dumping operation by bucket 6 is performed at the end of the work. Therefore, the position of boom 14 at the end of the work is often higher than in the excavation and loading work. In performing the piling work, wheel loader 1 may go up the slope of the pile of excavated object 100 so as to eject excavated object 100 scooped into bucket 6 at a higher position.

Dozing Work

Figure 7:
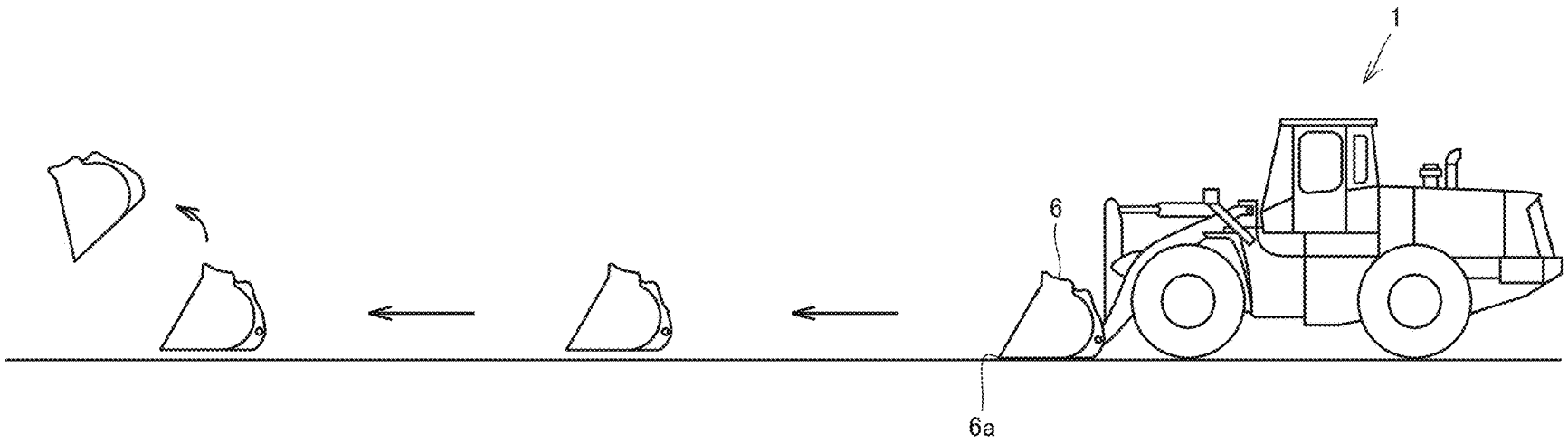
FIG. 7 is a diagram illustrating a dozing work by the wheel loader based on the embodiment.

Wheel loader 1 in the present embodiment performs a dozing (land grading) work for leveling the ground by traveling with cutting edge 6*a* of bucket 6 being located around the ground. FIG. 7 is a diagram illustrating a dozing work by wheel loader 1 based on the embodiment.

As shown in FIG. 7, after bucket 6 is arranged such that cutting edge 6*a* is located around the ground, wheel loader 1 travels forward as shown with an arrow in FIG. 7. The dozing work for land grading by leveling of the ground by cutting edge 6*a* of bucket 6 is thus performed. At the end of the dozing work, in order to eject soil that has entered bucket 6, bucket 6 may be caused to perform the dumping operation.

Method of Distinguishing Work Contents

Figure 8:
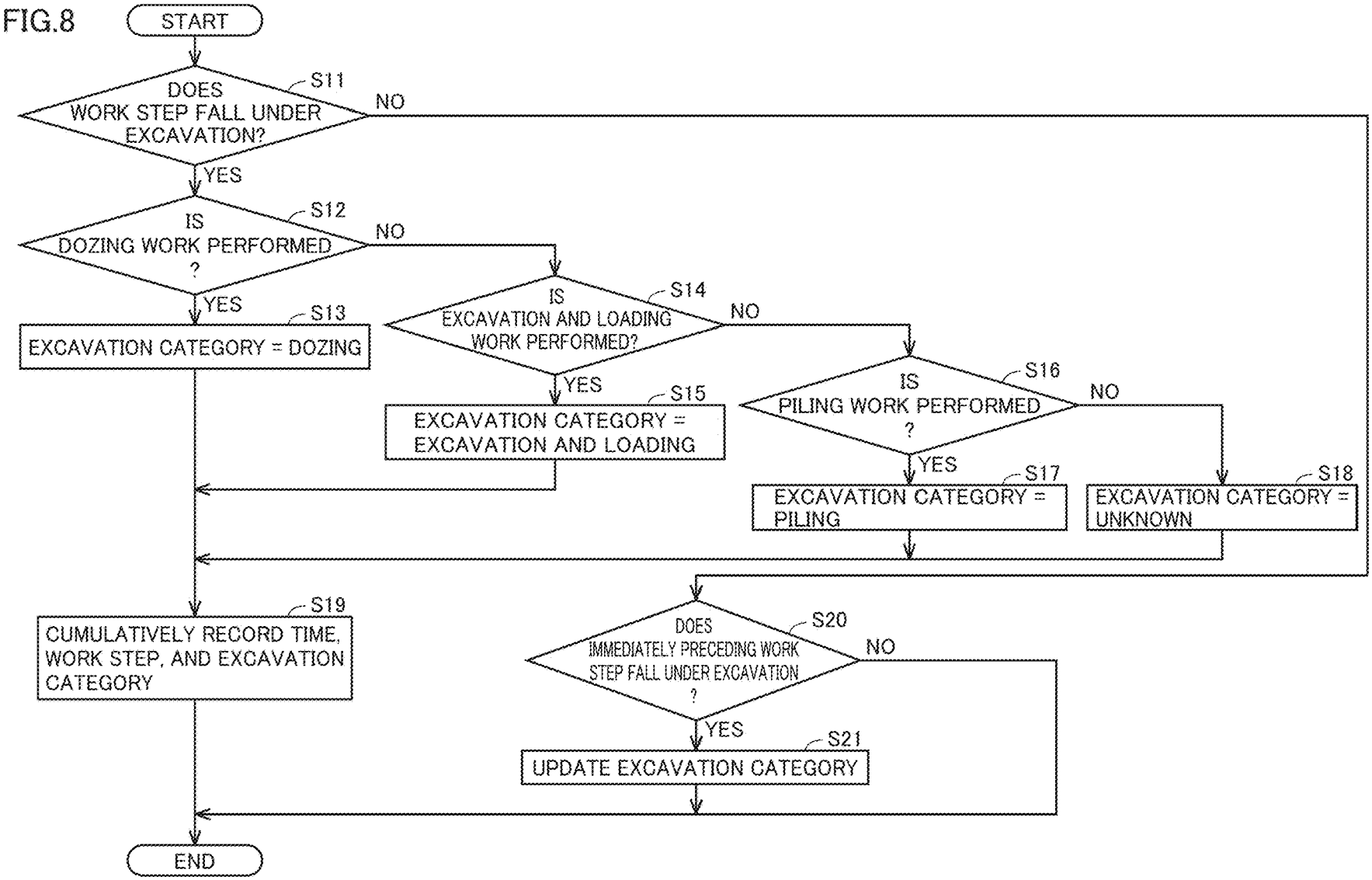
FIG. 8 is a flowchart showing processing for categorization of excavation in a first processor.

In wheel loader 1 in the present embodiment, first processor 30 determines under which of dozing, piling, and excavation and loading contents of works by work implement 3 fall. Such distinction among contents of works is defined as categorization of excavation. FIG. 8 is a flowchart showing processing for categorization of excavation in first processor 30.

As shown in FIG. 8, initially in step S11, whether or not the work step falls under excavation is determined. First processor 30 compares combination of a type of operation onto the forward and rearward travel switching lever, a type of operation onto the boom, a type of operation onto the bucket, and a hydraulic pressure of the boom cylinder at the current time point (that is, a current state of work) with combination of criteria for "forward and rearward travel switching lever," "boom", "bucket", and "pressure of cylinder of work implement" corresponding to each work step stored in advance as described with reference to FIGS. 4 and 5 and determines whether or not the current work step falls under excavation.

When the work step is determined as falling under excavation (YES in step S11), the excavation work is categorized in steps S12, S14, and S16. Specifically, under which of dozing, piling, and excavation and loading the excavation work falls is determined. Processing in steps S12, S14, and S16 is performed every sampling period of first processor 30, that is, in real time.

In step S12, whether or not a dozing work is being performed in the work step determined as falling under excavation is initially determined. FIG. 9 shows a table for distinguishing contents of works by wheel loader 1. FIG. 10 shows a graph of a trace of cutting edge 6*a* of bucket 6 during works by wheel loader 1. The abscissa in FIG. 10 (1) represents a trace of cutting edge 6*a* (cutting edge trace X, unit of m) of bucket 6 in a horizontal direction and the ordinate in FIG. 10 (1) represents a trace of cutting edge 6*a* (cutting edge trace Y, unit of m) of bucket 6 in a vertical direction. The abscissa in FIG. 10 (2) represents cutting edge trace X as in FIG. 10 (1) and the ordinate in FIG. 10 (2) represents a bucket angle (unit of °) described with reference to FIGS. 1 and 2.

FIG. 9 (A) shows a table for determining whether or not contents of works by wheel loader 1 fall under the dozing work. A curve (A) in FIG. 10 (1) shows exemplary relation between horizontal cutting edge trace X and vertical cutting edge trace Y during the dozing work. A curve (A) in FIG. 10 (2) shows exemplary relation between horizontal cutting edge trace X and a bucket angle during the dozing work.

As described with reference to FIG. 7, wheel loader 1 travels forward with cutting edge 6*a* of bucket 6 being arranged around the ground while it performs the dozing work. A height of vertical upward movement of cutting edge 6*a* during the dozing work is considerably smaller than a length of horizontal movement of cutting edge 6*a* with travel of wheel loader 1. As shown with the curve (A) in FIG. 10 (1), it can be seen that cutting edge trace X is longer than cutting edge trace Y in the dozing work, as compared with the cutting edge trace in the piling work or the excavation and loading work which will be described later.

Then, whether or not work contents fall under the dozing work is determined based on cutting edge trace X and cutting edge trace Y. Specifically, a coordinate of cutting edge trace X and cutting edge trace Y at a position of cutting edge 6*a* of bucket 6 at the end of the work is compared with a table where relation between cutting edge trace X and cutting edge trace Y is stored so that whether or not the work contents fall under the dozing work is determined.

More specifically, when the coordinate of cutting edge trace X and cutting edge trace Y at the position of cutting edge 6*a* of bucket 6 at the end of the work is included within a range in the table in which distinction as the dozing work is made, distinction as the dozing work is made. For example, when the position of cutting edge 6*a* of bucket 6 is close to the ground relative to the travel distance of wheel loader 1 and an operation to raise boom 14 is not performed or when the operation to raise boom 14 is performed but an amount of upward movement is small, the work contents are distinguished as the dozing work.

Alternatively, whether or not work contents fall under the dozing work can be determined also simply by comparing cutting edge trace X with a prescribed value without using cutting edge trace Y. For example, when a value of the coordinate of cutting edge trace X at the position of cutting edge 6*a* of bucket 6 at the end of the work is equal to or larger than a prescribed value, a travel distance of wheel loader 1 until the end of the work is long, and in this case, the work contents are distinguished as the dozing work.

In order to eject soil at the end of the dozing work, as shown in FIG. 9 (A), after boom 14 is once raised, bucket 6 is operated to perform dumping. Whether or not work contents fall under the dozing work may be determined based on change in operation onto the forward and rearward travel switching lever, change in operation onto the boom, change in operation onto the bucket, change in cutting edge trace X, change in cutting edge trace Y, change in bucket angle, or combination thereof.

When the work contents are distinguished as dozing in step S12 in FIG. 8, the process proceeds to step S13 and the work contents are stored with the excavation category being defined as dozing.

When the work contents are not distinguished as dozing in step S12, the process proceeds to step S14 and whether or not the excavation and loading work is being performed is determined. FIG. 9 (B) shows a table for determining whether or not contents of works by wheel loader 1 fall under the excavation and loading work. A curve (B) in FIG. 10 (1) represents exemplary relation between horizontal cutting edge trace X and vertical cutting edge trace Y during the excavation and loading work. A curve (B) in FIG. 10 (2) shows exemplary relation between horizontal cutting edge trace X and a bucket angle during the excavation and loading work.

When excavation and loading shown in FIG. 3 is performed, in order to scoop soil, a tilt back operation is performed during excavation as shown in the table in FIG. 9 (B). As shown with the curve B in FIG. 10 (2), a bucket angle is thus larger than in the piling work or the dozing work near the end of excavation.

Then, whether or not work contents fall under the excavation and loading work is determined based on a bucket angle. Specifically, whether or not work contents fall under the excavation and loading work is determined by comparing the bucket angle with a prescribed value. More specifically, when the bucket angle at the end of the work is larger than the prescribed value, work contents are distinguished as the excavation and loading work. Whether or not work contents fall under the excavation and loading work may be determined based on change in operation onto the forward and rearward travel lever, change in boom angle, change in bucket angle, change in cutting edge trace, or combination thereof.

When the work contents are distinguished as excavation and loading in step S14 in FIG. 8, the process proceeds to step S15 and the work contents are stored with the excavation category being defined as excavation and loading.

When work contents are not distinguished as excavation and loading in step S14, the process proceeds to step S16 and whether or not a piling work is being performed is determined. FIG. 9 (C) shows a table for determining whether or not contents of works by wheel loader 1 fall under a piling work. A curve (C) in FIG. 10 (1) represents exemplary relation between horizontal cutting edge trace X and vertical cutting edge trace Y during the piling work. A curve (C) in FIG. 10 (2) represents exemplary relation between horizontal cutting edge trace X and a bucket angle during the piling work.

In piling, as shown in the table in FIG. 9 (C), the dumping operation for ejecting soil in bucket 6 is performed near the end of excavation. Then, whether or not work contents fall under a piling work is determined based on the dumping operation of bucket 6 during excavation.

The dumping operation is performed near the end of excavation. Therefore, as shown with the curve (C) in FIG. 10 (1), cutting edge trace Y changes from raising to lowering. Therefore, whether or not the work contents fall under the piling work may be determined based on cutting edge trace Y.

As shown with the curve (C) in FIG. 10 (2), a value of a bucket angle is smaller than in excavation and loading. Therefore, whether or not work contents fall under a piling work may be determined based on a bucket angle.

When work contents are distinguished as piling in step S16 in FIG. 9, the process proceeds to step S17 and the work contents are stored with the excavation category being defined as piling.

When work contents are not distinguished as piling in step S16, the process proceeds to step S18 and the work contents are stored with the excavation category being unknown.

Excavation is categorized as unknown, for example, immediately after start of excavation. As shown in FIG. 9 (A) to (C) and shown with the curves (A) to (C) in FIG. 10, at a time point of start of excavation, there is no great difference in operation by the work implement among excavation and loading, piling, and dozing, and hence the excavation category may be determined as unknown.

As shown in FIGS. 9 and 10, a difference among dozing, excavation and loading, and piling becomes noticeable near the end of excavation. Therefore, an operation onto the forward and rearward travel switching lever may be added to the criteria as a condition for recognizing that excavation is in the last stage.

Based on data on distinction about the excavation category calculated in real time in steps S12 to S18 in FIG. 8, time, the work step, and the excavation category are cumulatively recorded in step S19. In other words, data on which a table shown in FIG. 11 which will be described later is based is recorded.

When the work step is not determined as falling under excavation (NO in step S11), whether or not the immediately preceding work step falls under excavation is determined in step S20. In step S20, whether or not the work step has proceeded from excavation to a work step other than excavation (excavation has ended) is determined.

When the immediately preceding work step is determined as excavation in step S20 (YES in step S20), the excavation category during a period from transition of the work step from a work step other than excavation to excavation until transition of the work step from excavation to a work step other than excavation, that is, from start of excavation until end of excavation, is updated in step S21.

Under which of dozing, piling, and excavation and loading contents of works by work implement 3 fall is thus determined (end in FIG. 8).

FIG. 11 shows an exemplary table showing work records. FIG. 11 shows a work step, work contents in the excavation step, and an excavation category representing work contents from a time point of start of the work until a time point of end of the work in the excavation step, at each time point from time 0 to time 24.

During a period from time 0 to 5, the work step falls under unloaded forward travel. During a period from time 6 to 21, the work step falls under excavation. During a period from time 22 to 24, the work step falls under loaded rearward travel. Since the work step does not fall under the excavation step during the period from time 0 to 5 and from time 22 to 24, work contents are not distinguished in accordance with a flow of the process shown in FIG. 8.

For example, when an operator operates forward and rearward travel switching apparatus 49 at time 13 and a rearward travel command is issued, work contents are distinguished as excavation and loading in accordance with the flow of the process shown in FIG. 8.

For example, when the operator operates bucket operation apparatus 54 at time 18 and a bucket dump command is issued, work contents are distinguished as piling in accordance with the flow of the process shown in FIG. 8.

After excavation ends, first processor 30 updates work contents during a period from start of the work (time 6) until end of the work (time 21) in the excavation step to work contents distinguished at the end of the work at time 21, that is, piling. Updated work contents during the period from time 6 to 21 are shown in a column of the excavation category (after update) in the table in FIG. 11.

Though first processor 30 distinguishes among dozing, piling, and excavation and loading in real time at each time from time 6 to 21, it does not immediately identify work contents distinguished at each time as work contents at each time but it identifies work contents during a period from start of the work until end of the work based on a result of distinction between at least two temporally distant work contents in work records during the period from the start of the work until the end of the work. As shown in FIG. 11, though work contents are distinguished, for example, as excavation and loading at time 13, work contents are identified as piling also at time 13 based on the fact that work contents are distinguished as piling at later time 21.

An example in which work contents during a period from start of the work until the end of the work are identified as piling and the work contents during the period from the start of the work until the end of the work are updated to piling is described with reference to FIG. 11. Similarly, work contents can be identified as excavation and loading based on a result of distinction between at least two temporally distant work contents in work records during a period from start of the work until the end of the work and the work contents during the period from start of the work until the end of the work can be updated to excavation and loading. Further similarly, work contents can be identified as dozing and the work contents during the period from start of the work until the end of the work can be updated to dozing.

For example, when bucket operation apparatus 54 is not operated at time 18 shown in FIG. 11 and no bucket dump command is issued, work contents are distinguished as falling under excavation and loading at time 21. In that case, work contents during the period from start of the work until the end of the work can be updated to excavation and loading.

Figure 12:
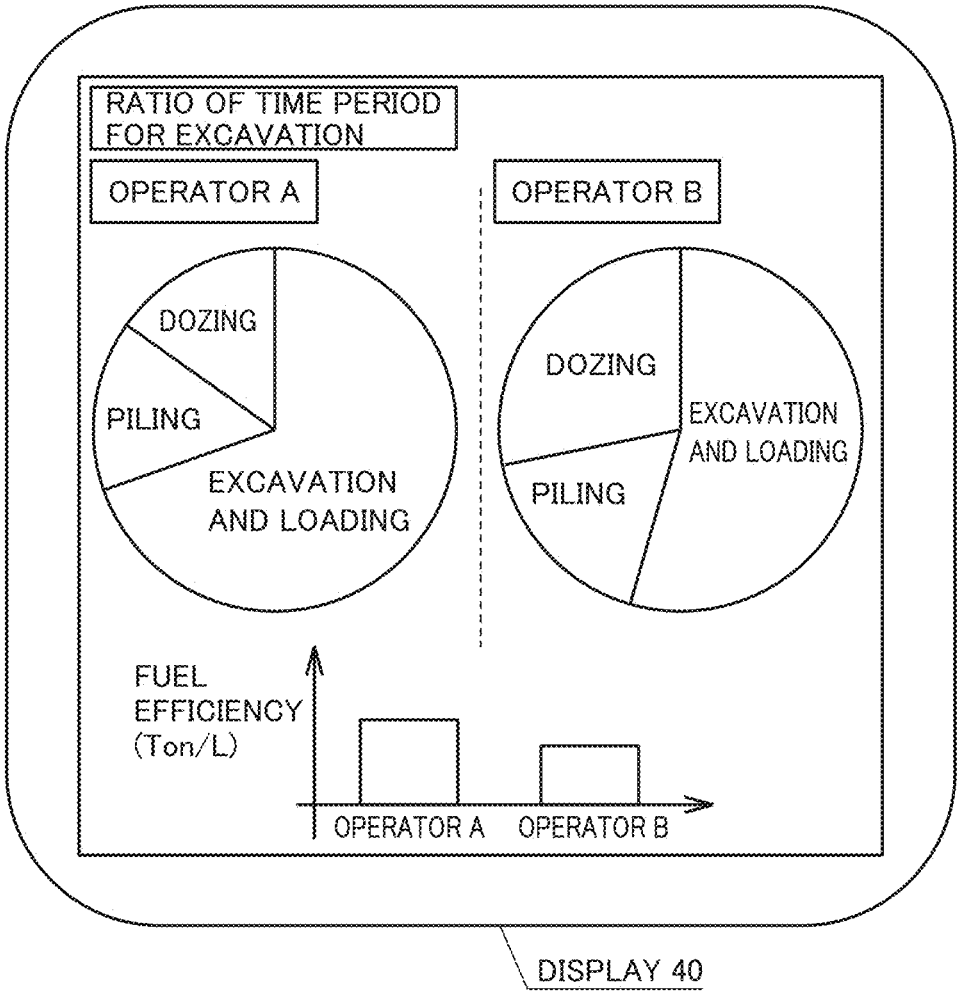
FIG. 12 is a schematic diagram showing a ratio of time period for each excavation category.

First processor 30 shown in FIG. 2 can output a result of work such as the cumulative number of times of work, a cumulative duration of work, and a cumulative amount of fuel consumption for each excavation category of dozing, piling, and excavation and loading identified as work contents during a period from start until end. FIG. 12 is a schematic diagram showing a ratio of a time period for each excavation category. FIG. 12 shows an example in which display 40 shows that approximately 70% of contents of work performed by an operator A falls under excavation and loading, approximately 55% of contents of work performed by an operator B falls under excavation and loading, operator A performs more work contributing productivity than operator B, and hence fuel efficiency (an amount of excavation and loading per unit fuel consumption amount) involved with work by operator A is higher than fuel efficiency involved with work by operator B.

Figure 13:
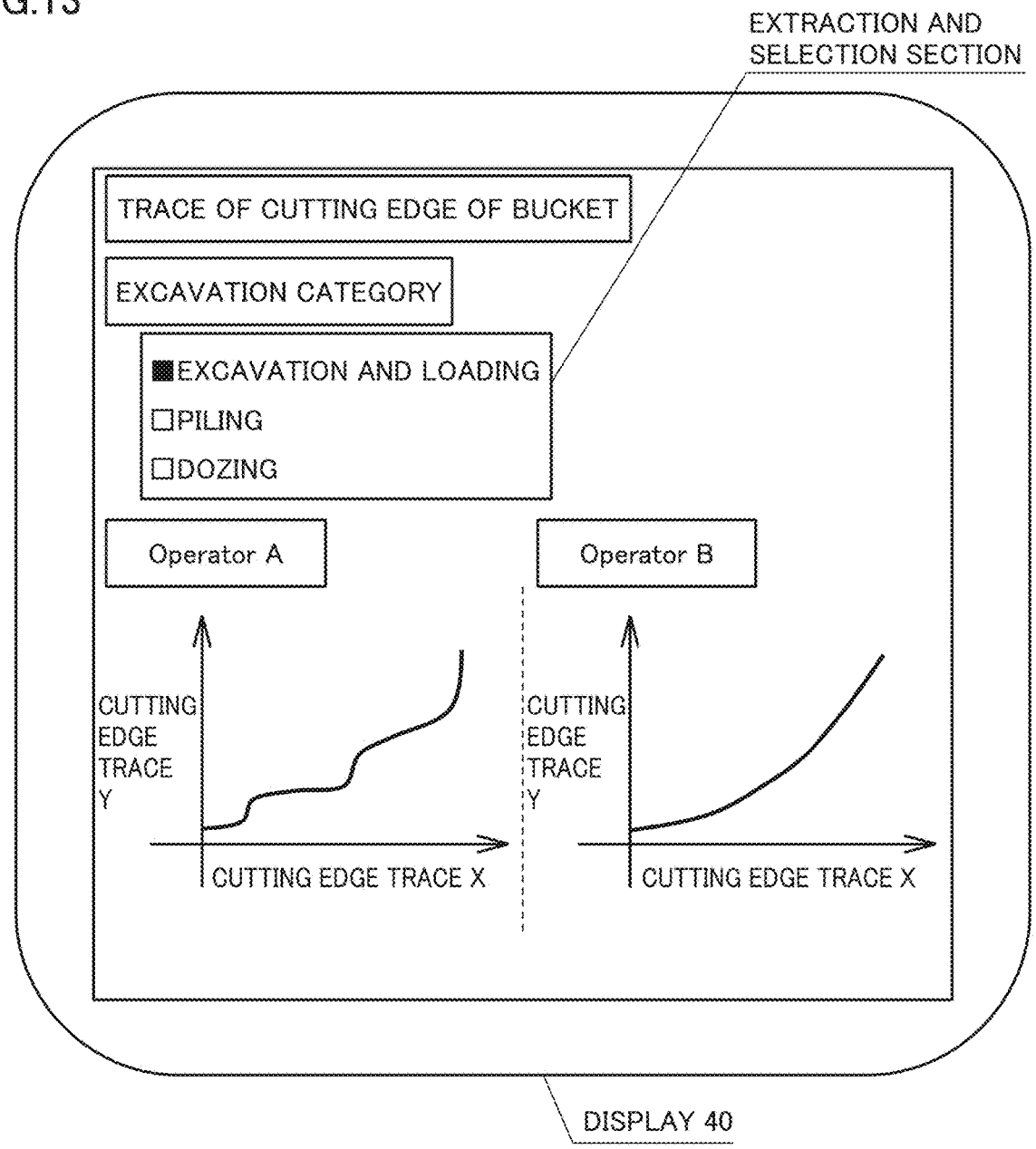
FIG. 13 is a schematic diagram showing a trace of operations by the work implement when an excavation and loading work is extracted.

First processor 30 can extract specific work contents from work contents of dozing, piling, and excavation and loading. First processor 30 can output a trace of operations by work implement 3 in extracted specific work contents. FIG. 13 is a schematic diagram showing a trace of operations by work implement 3 when an excavation and loading work is extracted. FIG. 13 shows an example in which a graph with the abscissa representing cutting edge trace X and the ordinate representing cutting edge trace Y shows a trace of operations by cutting edge 6*a* of bucket 6 during a period from start until end of works by operator A and operator B.

FIG. 13 also shows an example in which display 40 shows an extraction and selection section. FIG. 13 shows an example in which excavation and loading is selected as an item to be extracted and a trace of operations by cutting edge 6*a* of bucket 6 at the time when each operator performs excavation and loading is shown. By extracting the trace of operations by cutting edge 6*a* at the time when a skilled operator performs excavation and loading and using this data for training an unexperienced operator, the operator can efficiently be trained.

When display 40 is implemented by a touch panel, the operator can select work contents to be extracted by performing a touch operation onto the extraction and selection section shown in FIG. 13. Alternatively, the extraction and selection section shown in FIG. 13 may merely be representation, and a not-shown selection operation member such as a switch or a button may be operated by an operator to select work contents to be extracted.

By showing an operation onto forward and rearward travel switching apparatus 49, accelerator operation apparatus 51, boom operation apparatus 52, bucket operation apparatus 54, and brake operation apparatus 58 as well as a bucket angle in addition to the trace of operations by cutting edge 6*a* of bucket 6 shown in FIG. 13 together on display 40, further effective training can be performed.

Figure 14:
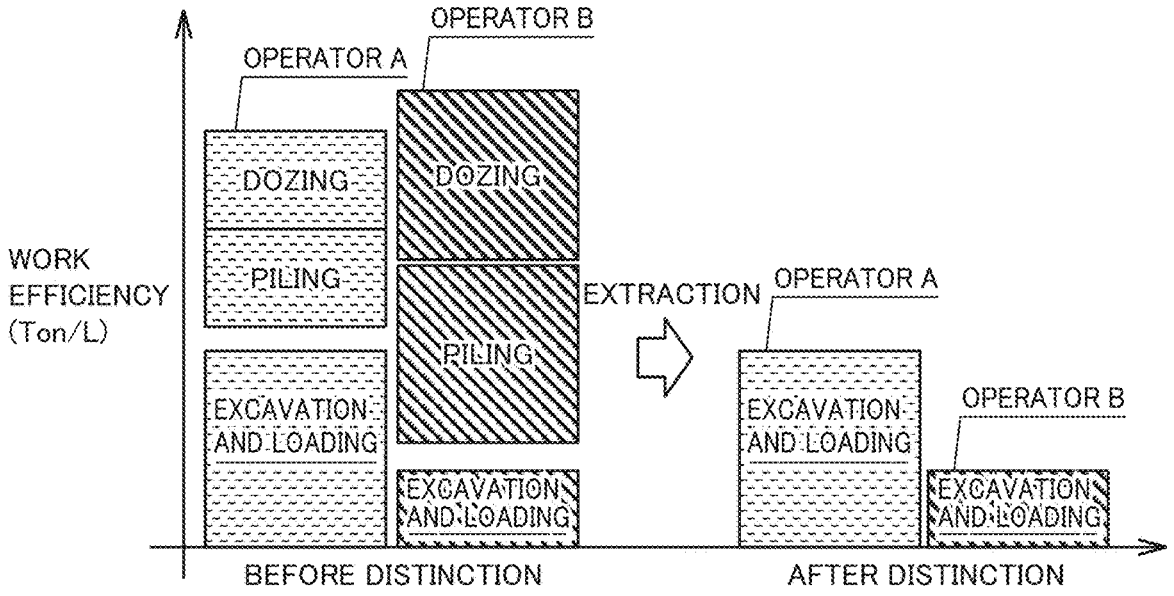
FIG. 14 is a schematic diagram showing comparison of an excavation and loading weight per unit fuel consumption amount before and after distinction of work contents.

First processor 30 can extract excavation and loading from works in which the boom is raised, that is, piling and excavation and loading, and can calculate an amount of excavation and loading per unit fuel consumption amount for excavation and loading. FIG. 14 is a schematic diagram showing comparison of an excavation and loading weight per unit fuel consumption amount before and after distinction between work contents. FIG. 14 shows comparison of an amount of loading of excavated object 100 per unit fuel consumption amount ("work efficiency" shown on the ordinate in FIG. 14, unit of Ton/L) between operator A and operator B "before distinction" which means that distinction between piling and excavation and loading has not been made and "after distinction" which means that only excavation and loading has been extracted.

By calculating an amount of loading per unit fuel consumption amount with only excavation and loading being extracted, net work efficiency of an operator can be evaluated.

For example, operator A and operator B are compared with each other in terms of work efficiency in FIG. 14. Operator A performs excavation and loading more than operator B and operator A performs piling and dozing less than operator B. In other words, operator A performs works contributing more to productivity more than operator B and works by operator A are desirable.

When evaluation is made without extracting excavation and loading, operator A is lower in work efficiency than operator B. Therefore, when works by operator A are evaluated without extraction of excavation and loading, erroneous evaluation that operator A is inferior to operator B is made.

In contrast, when evaluation is made with excavation and loading being extracted, operator A is higher in work efficiency than operator B. Therefore, work efficiency of operator A can more properly be evaluated.

Function and Effect

Functions and effects of the embodiment described above will now be described.

In the embodiment, first processor 30 as the controller identifies work contents during a period from start of work until end of the work based on a result of distinction between at least two temporally distant work contents in work records during the period from start of the work until the end of the work as shown in FIG. 11. A result of distinction between work contents at each time point is not immediately identified as work contents at each time point but work contents during the period from start of the work until the end of the work are identified based on a result of distinction between work contents at at least two temporally distant time points. Therefore, work contents can more accurately be distinguished.

As shown in FIG. 11, first processor 30 as the controller distinguishes work contents at the end of the work and identifies the work contents distinguished at the end of the work as work contents during the period from start of the work until the end of the work. The work contents during the period from start of the work until the end of the work may be updated to the work contents distinguished at the end of the work. According to the configuration in which work contents distinguished at the end of the work replace and update preceding work contents retrospectively rather than a configuration in which a result of distinction between work contents at each time point is immediately identified as work contents at each time point, work contents can more accurately be distinguished.

As shown in FIGS. 8 to 10, first processor 30 determines a work step of wheel loader 1 based on a signal from a sensor that detects a state of wheel loader 1. As shown in FIGS. 8 and 11, first processor 30 distinguishes work contents during the period from start of the work until the end of the work when the work step falls under the excavation step. According to the configuration in which work contents are not distinguished when the work step does not fall under excavation but work contents are distinguished when the work step falls under excavation, work contents can more accurately be distinguished.

As shown in FIG. 12, display 40 may output a result of work for each work content. By doing so, an operator or a manager can readily recognize at which ratio an excavation and loading work of all contents of works by the work implement is performed and accurately evaluate productivity.

Display 40 may also output for each work content, results of works by a plurality of operators. Since comparison of evaluation of productivity of the plurality of operators can thus readily be made, the operator can be encouraged to improve productivity.

As shown in FIG. 14, display 40 may output an amount of fuel consumption calculated with excavation and loading being extracted. It may be output together with an amount of fuel consumption of another operator.

As shown in FIG. 13, specific work contents such as excavation and loading may be extracted from work contents of dozing, piling, and excavation and loading. By extracting specific work contents, an amount of fuel consumption while those work contents are performed or a weight of excavated object 100 loaded onto a dump truck as a result of the excavation and loading work can accurately be calculated.

As shown in FIG. 13, an extraction and selection section in which work contents to be extracted are selected from among the work contents described above may be provided. The extraction and selection section may be provided on a display screen as shown in FIG. 13, as an embodiment of extraction.

Though FIG. 13 shows data on a trace of the cutting edge, shown data is not limited thereto. Records of operations onto an operation apparatus such as the boom operation apparatus, the bucket operation apparatus, the accelerator operation apparatus, or the brake operation apparatus or records of a bucket angle or a boom angle may be shown.

As shown in FIG. 13, display 40 may output a trace of operations by work implement 3 in the extracted specific work contents. For example, a trace of operations in an excavation and loading work by a skilled operator may be output and an unexperienced operator can be trained to operate work implement 3 along the output trace of operations. Training for operations can thus efficiently be performed.

A result of work and a trace of operations by work implement 3 may be output to display 40 or may be output, for example, to display 75 of second processor 70 through communication to second processor 70 via output unit 45 shown in FIG. 2. Alternatively, the result of work and the trace of the operations may be output as a daily report to a not-shown printer connected to second processor 70.

As shown in FIGS. 9 and 10, first processor 30 may distinguish work contents based on a trace of bucket 6. First processor 30 may find a boom angle and a bucket angle based on detection signals input from first angle detector 29 and second angle detector 48, find a vehicle speed of wheel loader 1 based on a detection signal input from vehicle speed detector 27, and find a position of cutting edge 6*a* of bucket 6 based thereon. First processor 30 can distinguish work contents as dozing based on the trace of operations by bucket 6 that connects a position of cutting edge 6*a* at the start of the work and a position of cutting edge 6*a* at the end of the work to each other.

First processor 30 may distinguish work contents based on a ratio between an angle of boom 14 with respect to the vehicular body and an angle of bucket 6 with respect to boom 14. First processor 30 can distinguish work contents as excavation and loading based on the boom angle and the bucket angle.

As shown in FIG. 9, first processor 30 may distinguish work contents based on a result of operations onto forward and rearward travel switching apparatus 49. First processor 30 can distinguish work contents as excavation and loading based on issuance of a rearward travel command.

As shown in FIG. 9, first processor 30 may distinguish work contents based on a result of operations onto bucket operation apparatus 54. First processor 30 can distinguish work contents as piling based on issuance of a dump command to bucket 6.

In FIG. 11, after the end of excavation, first processor 30 may have work contents during the period from time 6 to 21 recorded in another column in the table, instead of updating work contents during the period from start of the work (time 6) until the end of the work (time 21) in the excavation step to work contents distinguished at the end of the work at time 21, that is, to piling.

In the description of the embodiment, an example in which wheel loader 1 representing the work machine includes first processor 30 and first processor 30 mounted on wheel loader 1 distinguishes work contents is described. The controller that distinguishes work contents does not necessarily have to be mounted on wheel loader 1. A system in which first processor 30 of wheel loader 1 performs processing for transmitting detection signals input from various sensors to an external controller and the external controller that has received the detection signals distinguishes work contents may be configured.

In the description of the embodiment, an example in which wheel loader 1 represents the work machine that performs works including dozing, piling, and excavation and loading is described. The work machine is not limited to wheel loader 1 but may be a crawler loader or a backhoe loader.

It should be understood that the embodiment disclosed herein is illustrative and non-restrictive in every respect. The scope of the present invention is defined by the terms of the claims rather than the description above and is intended to include any modifications within the scope and meaning equivalent to the terms of the claims.

REFERENCE SIGNS LIST

1 wheel loader; 3 work implement; 6 bucket; 6*a* cutting edge; 14 boom; 16 boom cylinder; 19 tilt cylinder; 20 engine; 23 motive power transmission mechanism; 27 vehicle speed detector; 28*a*, 28*b* first hydraulic pressure detector; 29 first angle detector; 30 first processor; 40, 75 display; 48 second angle detector; 49 forward and rearward travel switching apparatus; 49*a* operation member; 49*b* member position detection sensor; 51 accelerator operation apparatus; 51*a* accelerator operation member; 51*b* accelerator operation detection unit; 52 boom operation apparatus; 52*a* boom operation member; 52*b* boom operation detection unit; 54 bucket operation apparatus; 54*a* bucket operation member; 54*b* bucket operation detection unit; 58 brake operation apparatus; 58 brake operation member; 58*b* brake operation detection unit; 70 second processor; 100 excavated object; 200 dump truck

The invention claimed is:

1. A work machine comprising:

a vehicular body;

a work implement attached to the vehicular body; and a controller that distinguishes a type of excavation work performed by the work implement based on operations performed by the work machine, the type of excavation work including at least two of dozing, piling, and excavation and loading, wherein the controller identifying, in real-time, the type of excavation work during a period from a start of the excavation work until an end of the excavation work based on the type of excavation work distinguished in real-time between at least two temporally distinct periods that the type of excavation work is performed, and updating the type of excavation work in work records during the period from the start of the excavation work until the end of the excavation work.

2. A work machine comprising:

a vehicular body;

a work implement attached to the vehicular body; and a controller that distinguishes a type of excavation work performed by the work implement based on operations performed by the work machine, the type of excavation work including at least two of dozing, piling, and excavation and loading, wherein the controller distinguishing the type of excavation work at an end of excavation work and identifying the distinguished type of excavation work at the end of the excavation work as the type of excavation work during a period from a start of the excavation work until the end of the excavation work.

3. The work machine according to claim 2, wherein the controller updates the type of excavation work during the period from the start of the works until the end of the excavation work, to the distinguished type of excavation work at the end of the excavation work.

4. The work machine according to claim 1, further comprising at least one sensor that detects a state of the work machine, wherein the controller determines a work step of the work machine based on a signal from the sensor, and when the work step falls under an excavation step, the controller distinguishes the type of excavation work during the period from the start of the excavation work until the end of the excavation work.

5. The work machine according to claim 1, wherein the controller outputs results of the excavation work for each identified type of excavation work.

6. The work machine according to claim 5, wherein the controller outputs for each operator, the results of the excavation work by a plurality of operators.

7. The work machine according to claim 1, wherein the controller extracts a specific type of excavation work from the identified type of excavation work.

8. The work machine according to claim 7, wherein the controller further includes a selection section in which a type of excavation work to be extracted are selected.

9. The work machine according to claim 7, wherein the controller outputs a trace of operations by the work implement in the extracted specific type of excavation work.

10. The work machine according to claim 7, further comprising an operation apparatus for operating the work machine, wherein the controller outputs records of operations onto the operation apparatus in the extracted specific type of excavation work.

11. The work machine according to claim 7, further comprising a work implement angle detection device that detects an angle of the work implement, wherein the controller outputs records of angles of the work implement in the extracted specific type of excavation work.

12. The work machine according to claim 1, wherein the work implement includes a bucket, and the controller distinguishes the type of excavation work based on a trace of the bucket.

13. The work machine according to claim 1, wherein the work implement includes a boom and a bucket, and the controller distinguishes the type of excavation work based on a ratio between an angle of the boom with respect to the vehicular body and an angle of the bucket with respect to the boom.

14. The work machine according to claim 1, further comprising a forward and rearward travel switching apparatus operated for switching between forward travel and rearward travel of the work machine, wherein the controller distinguishes the type of excavation work based on a result of operation onto the forward and rearward travel switching apparatus.

15. The work machine according to claim 1, wherein the work implement includes a bucket, the work machine further comprises a bucket operation apparatus operated for operating the bucket, and the controller distinguishes the type of excavation work based on a result of operation onto the bucket operation apparatus.

16. The work machine according to claim 1, wherein when the type of excavation work distinguished before the end of the excavation work fall under excavation and loading and the type of excavation work distinguished at the end of the excavation work fall under piling, the controller identifies the type of excavation work during the period from the start of the excavation work until the end of the excavation work as piling.

17. A system including a work machine, the work machine including a vehicular body and a work implement attached to the vehicular body, the system comprising:

a controller that distinguishes a type of excavation work performed by the work implement based on operations performed by the work machine, the type of excavation work including at least two of dozing, piling, and excavation and loading, wherein the controller identifying, in real-time, the type of excavation work during a period from a start of the excavation work until an end of the excavation work based on the type of excavation work distinguished in real-time between at least two temporally distinct periods that the type of excavation work is performed, and updating the type of excavation work in work records during the period from the start of the excavation work until the end of the excavation work.

18. A system including a work machine, the work machine including a vehicular body and a work implement attached to the vehicular body, the system comprising:

a controller that distinguishes a type of excavation work performed by the work implement based on operations performed by the work machine, the type of excavation work including at least two of dozing, piling, and excavation and loading, wherein the controller distinguishing the type of excavation work at an end of excavation work and identifying the distinguished type of excavation work at the end of the excavation work as the type of excavation work during a period from a start of the excavation work until the end of the excavation work.

* * * * *